US007256224B2

(12) United States Patent
Martin et al.

(10) Patent No.: US 7,256,224 B2
(45) Date of Patent: Aug. 14, 2007

(54) STABILIZED POLYMER DRAG REDUCING AGENT SLURRIES

(75) Inventors: Thomas J. Martin, Bixby, OK (US); Lu Chien Chou, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 1 day.

(21) Appl. No.: 11/232,352

(22) Filed: Sep. 21, 2005

(65) Prior Publication Data

US 2007/0066713 A1 Mar. 22, 2007

(51) Int. Cl.
*B05D 5/08* (2006.01)

(52) U.S. Cl. ..... 523/175; 524/275; 524/276; 524/277

(58) Field of Classification Search ..... 523/175; 524/275, 276, 277
See application file for complete search history.

(56) References Cited

U.S. PATENT DOCUMENTS

| | | | |
|---|---|---|---|
| 4,084,993 | A | 4/1978 | Cook |
| 4,384,616 | A | 5/1983 | Dellinger |
| 4,584,244 | A | 4/1986 | Fenton |
| 4,720,397 | A | 1/1988 | O'Mara et al. |
| 4,789,383 | A | 12/1988 | O'Mara et al. |
| 4,826,728 | A | 5/1989 | O'Mara et al. |
| 4,837,249 | A | 6/1989 | O'Mara et al. |
| 5,165,440 | A | 11/1992 | Johnston |
| 5,165,441 | A | 11/1992 | Mitchell |
| 5,244,937 | A | 9/1993 | Lee et al. |
| 5,376,697 | A | 12/1994 | Johnston et al. |
| 5,449,732 | A | 9/1995 | Smith et al. |
| 5,504,131 | A | 4/1996 | Smith et al. |
| 5,504,132 | A | 4/1996 | Smith et al. |
| 5,539,044 | A | 7/1996 | Dindi et al. |
| 5,582,250 | A | 12/1996 | Constein |
| 5,961,804 | A | 10/1999 | Jacobson et al. |
| 6,039,932 | A | 3/2000 | Govind et al. |
| 6,126,872 | A | 10/2000 | Kommareddi et al. |
| 6,160,036 | A | 12/2000 | Kommareddi et al. |
| 6,172,151 | B1 | 1/2001 | Johnston et al. |
| 6,399,676 | B1 | 6/2002 | Labude et al. |
| 6,576,732 | B1 | 6/2003 | Milligan et al. |
| 6,596,832 | B2 | 7/2003 | Johnston et al. |
| 6,649,670 | B1 | 11/2003 | Harris et al. |
| 6,841,593 | B2 | 1/2005 | Kommareddi et al. |
| 6,939,902 | B2 | 9/2005 | Smith et al. |
| 2003/0013783 | A1 | 1/2003 | Kommareddi et al. |
| 2003/0065054 | A1 | 4/2003 | Smith et al. |
| 2003/0109397 | A1 | 6/2003 | Aouad et al. |
| 2003/0187123 | A1 | 10/2003 | Labude et al. |
| 2004/0110645 | A1 | 6/2004 | Campbell et al. |
| 2004/0198619 | A1 | 10/2004 | Eaton et al. |

*Primary Examiner*—Edward J. Cain
(74) *Attorney, Agent, or Firm*—Madan, Mossman & Sriram PC

(57) ABSTRACT

A method for producing a stabilized polymer drag reducing agent slurry comprising combining a fatty acid wax and a liquid carrier to form a dispersion; pre-treating the dispersion by heating to partially dissolve the fatty acid wax in the liquid carrier; and adding the polymer drag reducing agent thereto, to form a stabilized polymer drag reducing agent slurry. The resulting slurry is relatively stable against settling, separation and agglomeration.

29 Claims, No Drawings

STABILIZED POLYMER DRAG REDUCING AGENT SLURRIES

FIELD OF THE INVENTION

The invention relates to processes for producing polymeric drag reducing agents, and more particularly to processes for producing stabilized slurries of polymeric drag reducing agents.

BACKGROUND OF THE INVENTION

The use of polyalpha-olefins or copolymers thereof to reduce the drag of a hydrocarbon flowing through a conduit, and hence the energy requirements for such fluid hydrocarbon transportation, is well known. These drag reducing agents, or DRAs, have taken various forms in the past, including slurries of ground polymers to form free-flowing and pumpable mixtures in liquid media.

In general, the DRA polymer may be obtained via solution polymerization of an alpha olefin monomer, or a mixture of olefinic monomers, or from bulk polymerization (i.e., without solvent) of such monomer(s). The DRA polymer may then be subsequently made into particulate form by cutting, chopping, granulating, and/or grinding, at cryogenic or ambient temperatures. Alternatively, it may be precipitated from solution by addition of a non-solvent component. Mixtures of polymer solids from both sources may be used.

A problem that has been frequently addressed in the art, however, is that there is a natural tendency for such slurries, containing the particulate polymer DRA, to settle over time, or to separate or agglomerate such that the slurries no longer maintain a free-flowing and pumpable nature. A generalized description of how this problem has been addressed is that the slurry of polymer DRA and liquid carrier also frequently includes a partitioning agent, a wetting agent, and/or a rheology modifier. These three components, which are frequently all included, are referred to generally as "suspension aids". The purpose of the partitioning agent is to physically hold the polymer DRA particle surfaces apart. The purpose of the wetting agent is to wet the polymer DRA surface, and the purpose of the rheology modifier is to increase the viscosity of the liquid carrier to slow down polymer DRA particle settling or rising. In some cases a single ingredient may serve multiple purposes within the suspension aid package.

The liquid carrier is, in some embodiments, a non-solvent for the polymer DRA and may vary widely. Selections for this component may include both aqueous and non-aqueous liquids, including, for example, water and aqueous solutions of varying pH and ionic strength; alcohols and fatty alcohols; glycols and diols; glycol ethers; glycol esters; mixtures of these; and the like.

The wetting agent is virtually always included in such formulations. Without a wetting agent the liquid carrier would quickly drain away from a non-wetted polymer surface. This would result in a highly separated slurry. Fatty acid waxes have been used as wetting agents, as well as commercially available surfactants, such as Span™, Tween™, Brij™, and Myrj™. These surfactants, which are generally sorbitan esters, ethoxylated sorbitan esters, alcohol ethoxylates and polyoxyethylene fatty acids, are available from Uniqema.

Inclusion of a partitioning agent is also generally desirable in these slurries. This is because polymer DRNs are often in the form of soft, tacky particles that will agglomerate, or "cold flow", when their unaltered surfaces come into contact with one another. Again, fatty acid waxes are often used as partitioning agents, as well as polyolefin homopolymers and copolymers of various densities; oxidized polyethylene: polystyrene and copolymers; carbon black and graphites; precipitated and fumed silicas; natural and synthetic clays, and organo-clays; aluminum oxides; talc; boric acid; polyanhydride polymers; sterically hindered alkyl phenol oxidants; magnesium, calcium and barium phosphates, sulfates, carbonates and oxides; mixtures thereof; and the like.

A rheology modifying agent may, in some embodiments, also be added to reduce separation of the polymer DRA slurry. By adding the modifying agent to the liquid carrier, settling or rising of the DRA polymer may be hindered or prevented. Some rheology modifiers, such as modified cellulosics and natural gums, may be heated to effect complete dissolution and may also function as wetting agents. However, these have no particulate properties that would render them capable of also serving as partitioning aids. A further disadvantage to this approach is that the higher viscosity automatically reduces the flowability properties of the polymer DRA slurry.

Another practice employed to stabilize polymer DRA slurries is to match the suspended particle density to the liquid carrier density, by using a combination of carrier components in appropriate proportions. The drawback to this practice is that there are relatively few available selections for carriers that are economical, have the desired densities, and also exhibit desirable hydrophobic or hydrophilic properties.

In view of the above, there is still a need in the art to discover ways to produce stabilized polymer DRA slurries that are convenient and economical and which do not suffer from the drawbacks listed hereinabove.

SUMMARY OF THE INVENTION

An object of the invention is to provide a method for producing a polymer drag reducing agent slurry that can be readily shipped and stored for extended periods of time.

Another object of the invention is to provide a method for producing a polymer drag reducing agent slurry that is relatively stable against settling, separation and/or agglomeration.

In carrying out these and other objects of the invention, there is provided, in one aspect, a method for producing a stabilized polymer drag reducing agent slurry comprising combining a fatty acid wax and a liquid carrier to form a dispersion; pre-treating the dispersion by heating to partially dissolve the fatty acid wax in the liquid carrier; and combining therewith a particulate polymer drag reducing agent, to form a stabilized polymer drag reducing agent slurry.

In another aspect the invention provides a stabilized polymer drag reducing agent slurry produced by combining a fatty acid wax and a liquid carrier to form a dispersion; pre-treating the dispersion by heating to partially dissolve the fatty acid wax in the liquid carrier; and combining therewith a particulate polymer drag reducing agent, to form a stabilized polymer drag reducing agent slurry.

The inventive polymer DRA slurry is relatively stabilized against settling, separation and agglomeration.

DETAILED DESCRIPTION OF THE INVENTION

In general, the invention includes both a method of preparing a stabilized polymer DRA slurry, and the stabilized slurry prepared thereby. Its key feature is first combining the fatty acid wax and the liquid carrier and heating them together sufficiently to partially dissolve the wax in the liquid carrier. This pre-treatment imparts superior resistance to settling, separation and agglomeration when the polymer DRA is then combined with the wax/carrier combination to form the slurry. It is both economical and convenient to practice. While art-known stabilizations include use of fatty acid waxes, none has discerned or suggested the improvement attained when the fatty acid wax and liquid carrier are first heated together, and when the wax is partially dissolved in the liquid carrier.

This fatty acid wax may be selected from the group consisting of fatty acids, fatty acid salts, fatty acid esters, and fatty acid amides. In one non-limiting embodiment, these include Groups 1, 2, 12, and 13 (IUPAC standard notation) metal salts of stearic acid; stearic acid amides; and stearic acid esters. Such may include, for example, magnesium stearate, calcium stearate, zinc stearate, aluminum stearate, sodium stearate, and potassium stearate, as well as ethylene bis-stearamide, stearamide, ethylene glycol monostearate, ethylene glycol distearate, propylene glycol monostearate, propylene glycol distearate, glycerol stearate, glycerol distearate, glycerol tristearate, diethylene glycol distearate, stearic anhydride, and combinations thereof. "Stearic acid" and "stearates", as used herein, refer, respectively, to fatty acids and fatty acid derivatives containing a range of carbon chain lengths, provided that the compound meets the definition of a wax, i.e., is solid at ambient temperature. They may be either saturated or unsaturated compounds. In some non-limiting embodiments chain lengths from about C10 to about C24 may be selected. In other non-limiting embodiments a carbon chain length of about C18 may be effectively selected.

The fatty acid waxes may be used in the invention in neat form, from commercial or in-house sources, for example, or may be formed in situ in the liquid carrier, for example, by mixing stearic acid and amines or a metal hydroxide therein, followed by heating. Mixtures of the various wax types may also be used.

The liquid carrier may be any that are typically used for preparing polymer DRA slurries, but are generally non-solvents for the polymer DRA. Such may be selected from both aqueous and non-aqueous liquids, according to economy, convenience, and, desirably, the nature of the stream in which the polymer DRA slurry will be ultimately used for drag reduction. Water itself, as well as aqueous solutions having adjusted pH and/or ionic strengths or other desired modifications may, in some non-limiting embodiments, be advantageously employed. In other non-limiting embodiments alcohols and fatty alcohols, glycols and diols, glycol ethers, glycol esters, or mixtures of these may provide the desired liquid carrier.

A key to the invention is first combining the fatty acid wax and the liquid carrier to form a dispersion (without presence of the polymer DRA). This dispersion is then pre-treated by heating sufficiently to partially dissolve the fatty acid wax in the liquid carrier. This pre-treatment is unique, because the fatty acid wax functions both as a partitioning agent in the suspending liquid carrier, in its non-dissolved form, and as a wetting agent and rheology modifier, in its dissolved form.

The time and temperature at which the dispersion is pre-treated will obviously vary according to the selection of liquid carrier(s) and fatty acid wax(es). However, heating above ambient temperature is necessary in order to accomplish the desired level of dissolution. Such dissolution level is, in one desirable and non-limiting embodiment, less than 99 percent by weight of the total fatty acid wax dispersed in the liquid carrier, but at least about 0.5 percent by weight of the fatty acid wax. In another non-limiting embodiment, the level is less than about 10 percent by weight, and in still another non-limiting embodiment, the level is less than about 5 percent by weight, but in both of these exemplary embodiments it is at least about 1 percent by weight. For example, a proportion of ethylene bis-stearamide (EBS) may be combined with hexanol in a proportion of about 5.7 percent by weight of EBS. This dispersion may be heated, at about 130° F. (~54° C.), for about 4 hours. After cooling to ambient and filtering to remove any non-dissolved EBS, it is found that the filtrate contains about 0.25 percent by weight of EBS, from which it may be inferred that about 4 percent by weight of the original EBS solids is dissolved in the hexanol. Heating temperatures may, in some non-limiting embodiments, range from about 80 to about 200° F. (~27 to ~93° C.), and in other non-limiting embodiments may range from about 120 to about 150° F. (~49 to ~66° C.). Times may, in some embodiments, range from about 0.5 hour to about 10 hours, and in other non-limiting embodiments, from about 1 to about 5 hours. While time is not per se critical, provided that the appropriate level of dissolution is attained, it may be desirable in some cases to avoid heating for longer than necessary. This is because the dispersion may then tend to form a relatively immobile jelly-like material resembling common grease. Achieving such a highly viscous state may be an impediment to forming a satisfactory slurry once the polymer DRA is added.

The proportional ratio of fatty acid wax to liquid carrier may, in some non-limiting embodiments, be from about 0.005:1 to about 0.2:1. In yet other non-limiting embodiments, the ratio may be from about 0.007:1 to about 0.19:1, and in still other non-limiting embodiments, from about 0.01:1 to about 0.2:1. In other non-limiting embodiments, the ratio of wax to DRA polymer may be from about 0.02:1 to about 0.48:1. In certain non-limiting embodiments, the wax concentration in the total slurry may range from about 0.1 to about 30 percent by weight, and in other non-limiting embodiments, it may range from about 0.5 to about 12 percent by weight, based on the weight of the slurry as a whole.

Appropriate levels of dissolution may be confirmed both visually and by measurement of viscosity. For example, once a partial dissolution has taken place as a result of the heating, viscosity will increase. In certain non-limiting embodiments, this viscosity increase is at least about 100 percent, provided that the solution is not transparent to light, i.e., it must be either translucent or opaque. It is important to note that dissolution generally occurs at a temperature significantly below the temperature at which melting of the fatty acid wax occurs, and in some embodiments at least about 70 degrees Fahrenheit (126 degrees Celsius) below the melt temperature. In many cases, the difference between dissolution and melt temperatures will be much greater.

Another measure of partial dissolution is the particle size of the fatty acid wax. Viscosity increase correlates to particle size in some embodiments, and thus, as the average particle size increases by, in some non-limiting embodiments, at least about 10 percent of initial size, the viscosity will increase proportionately, in some embodiments to a level of 100 percent of the initial viscosity. Generally, the particle size increase may be graphically compared with heating time at a constant temperature and, as heating continues, particle size increases asymptotically. Without wishing to be bound by any theory, it is hypothesized that particle size increase is due to swelling and/or an Ostwald Ripening effect, in which the thermodynamics of the system favor growth of large particles at the expense of smaller ones during the simultaneous solvation and crystallization of the wax molecules.

Following the pre-treatment step, the dispersion may be cooled back to ambient temperature, or, in some embodiments, to any temperature that is at least about 20 degrees Fahrenheit (~36 degrees Celsius) lower than the heating temperature. Such cooling enables the amount of wax dissolved to remain relatively constant or to change only very slowly over a prolonged time period. Temperature control of the pre-treated material is not critical at this point, provided it is maintained significantly below the heating temperature, and in some non-limiting embodiments, at least about 20 degrees Fahrenheit (~36 degrees Celsius) below the heating temperature.

The pre-treated dispersion is now ready for combination with at least the polymer DRA to complete formation of a stabilized polymer DRA slurry. Polymer DRN's are, in some embodiments, ultra-high molecular weight poly alpha olefins which have been formed by polymerization of a selected alpha olefin monomer or combinations of alpha olefin monomers. This polymerization may be either a solution polymerization, wherein the polymer is precipitated from the solution via addition of a non-solvent component, or a bulk polymerization wherein no solvent is included.

The polymer DRA is desirably combined with the dispersion in a comminuted form, and in some non-limiting embodiments, in a relatively highly comminuted form. For example, the polymer DRA may be first granulated to relatively large particulate form, followed by grinding to further reduce particle size. In some embodiments the particle size at the point of dispersion is desirably less than about 1 mm in diameter, and in other embodiments it is less than about 600 microns in diameter. Such small particle size helps, in itself, to maintain the suspension of the polymer DRA and also increases the rapidity of dispersion throughout the stream into which the polymer DRA slurry will be injected and wherein drag reduction is desired.

The polymer DRA may be combined while the pre-treated dispersion including the liquid carrier and partially dissolved fatty acid wax is at any temperature wherein the partial dissolution of the fatty acid wax may be maintained. Such temperature is, in some non-limiting embodiments, higher than ambient temperature, but lower than the melting temperature for the fatty acid wax. Using such a closely-controlled temperature helps to avoid the possibility of precipitation of a significant portion of the dissolved fatty acid wax out of solution.

While a stabilized polymer DRA slurry has now been formed, it is possible to include further components therein. Such additional component(s) may be added either before, concurrently with, or after combination of the particulate polymer DRA and liquid carrier/fatty acid wax dispersion, but in all cases are combined after the pre-treatment of the dispersion. Such additional components may include, for example, additional partitioning agents, wetting agents, and/or rheology modifiers that may in some cases be desirable to further enhance their imparted properties in a given slurry. Such enhancement may be desired according to all of the variables of a given system, including selection of each component of the slurry, the constituency and properties of the stream in which drag will be reduced, type of pumping equipment being used, desired flow rate, and the like. Materials known in the art to be useful for each of the types of additives may be used. For example, in certain non-limiting embodiments, one or more additional partitioning agents may be selected from the group consisting of fatty acid waxes (to be distinguished herein from the fatty acid waxes included in the pre-treatment of the dispersion including a fatty acid wax and a liquid carrier), polyolefin homopolymers and copolymers of various densities; oxidized polyethylene; polystyrene and copolymers; carbon black and graphites; precipitated and fumed silicas; natural and synthetic clays and organo-clays; aluminum oxides; talc; boric acid; polyanhydride polymers; sterically hindered alkyl phenol oxidants; magnesium, calcium and barium phosphates, sulfates, carbonates and oxides; mixtures thereof; and the like.

Additional wetting agents may, in some exemplary and non-limiting embodiments, be selected from the group consisting of fatty acid waxes, magnesium stearate, calcium stearate, stearamide, ethylene bis stearamide, nonyl phenol and nonyl phenol ethoxylates, and laureth carboxylic acid, as well as commercially available surfactants such as Tween™, Span™, Brij™, and Myrj™. These surfactants are available from Uniqema. Cationic and anionic surfactant types are of use also, such as, for example, cetyltrimethylammonium-bromide, sodium dodecyl sulfate, and sodium alkylbenzene sulfonic acid.

Additional rheology modifiers may, in some exemplary and non-limiting embodiments, be selected from the group consisting of natural gums including, for example, gum arabic, xanthan gum, and guar gum; carrageenan; cellulosics such as hydroxypropyl methyl cellulose, carboxy methyl cellulose, hydroxypropyl cellulose, and hydroxyethyl cellulose; and natural clays.

Relative proportions of all of the polymer DRA slurry constituents will, naturally, have an effect upon the final properties, including but not limited to stability to settling, separation and/or agglomeration, of the polymer DRA slurry. While a wide range of proportions may be employed according to the desirable properties of the final slurry, it has been found that, in certain embodiments, a ratio of polymer DRA to overall slurry ranging from about 10 to about 40 percent by weight is effective, while in other embodiments a ratio of polymer DRA to pre-treated dispersion may range from about 17 to about 26 percent by weight. Where additional partitioning agent is to be included it may be, in certain non-limiting embodiments, in the range of from about 2 to about 10 percent by weight, as compared to the overall slurry. Additional wetting agent may, in certain non-limiting embodiments, range from about 0.1 to about 2.0 percent by weight, as compared to the overall slurry, and additional rheology modifying agent may, in other non-limiting embodiments, range from about 0.01 to about 1.50 percent by weight.

Once all constituents of the final slurry have been combined, and in some embodiments during such combination, appropriate mixing is desirable. Such may be carried out using any method and/or means known to those skilled in the art. The goal of mixing is desirably a relatively high level of homogenization, which serves to enhance consistency in the drag reducing performance of the product, and to reduce the occurrence of settling, separation and/or agglomeration later by ensuring uniformity in the presence of each component such that partitioning and wetting actions are optimized. In some non-limiting embodiments such mixing may be accomplished by use of a standard fixed blade agitator or high-shear impeller in a drum, tank or vessel for a time of from about 0.5 to about 4 hours at ambient temperatures.

The final slurry is, in some embodiments, a highly uniform polymer DRA slurry that is ready for shipment, storage and/or use for drag reduction in a variety of streams such as hydrocarbons, including, for example, crude oil, heating oils, liquefied natural gas, refined gasoline, and diesel fuel. It may be highly stable against settling, separation and/or agglomeration, with the occurrence of one or more of these events delayed for a time period of at least one day, and in many embodiments for a time period measured in days, weeks or months. Such stability may be evinced even when the slurry is stored for times exceeding six months and under a variety of conditions ranging from extreme cold (for example, as low as about −40° F. (~−40° C.) to extreme heat (for example, as high as about 120° F. (~49° C.).

The following examples are included herein for illustrative purposes only, and are not intended to be, nor should they be construed as being, indicative in any way of the scope of the invention. Those skilled in the art will appreciate that many modifications may be made in the invention without departing from the spirit and scope, as defined in the appended claims, thereof. For example, the identity, nature and proportions of fatty acid wax, liquid carrier, polymer DRA, and other partitioning agents, wetting agents, and/or rheology modifying agents; times and temperatures of pre-treatment; equipment used to prepare any component or the slurry as a whole; and the like; may also be varied while remaining within the scope of the invention.

EXAMPLES

Example 1

A 9.6 g quantity of calcium stearate is added to 150 g of 1-hexanot as a liquid carrier to form a dispersion. This dispersion is pre-treated by heating at 140° F. (60° C.) for about 4 hours. The result is a thick, milky-white suspension. This suspension is filtered to discover that less than about 1 percent by weight of the calcium stearate is present in a dissolved state. A 79.8 g quantity of this admixture is then combined with about 75 g of additional 1-hexanol, about 190.7 g of dipropylene glycol methyl ether, and 149.8 g of a precipitated poly alpha olefin polymer DRA material. The combination is then mixed with a dispersion-type mixer for about 15 minutes. The resulting polymer DRA slurry is stable toward separation after sifting for several weeks, and exhibits a stable viscosity of 900-1100 centipoise, as measured using temperature correction with a Brookfield DV-II+ viscometer using a "T-A" spindle at 20 rpm (helical path) at ambient temperature.

Example 2

About 26.4 g of ethylene bis-stearate is added to about 150 g of 1-hexanol and heated at about 140° F. (60° C.) for 4 hours. The result is a milky white suspension. About 88.2 g of this admixture is combined with about 75 g of additional 1-hexanol, 190.7 g of dipropylene glycol methyl ether, and 149.8 g of the same precipitated polymer DRA material as in Example 1. This combination is then mixed using a dispersion-type mixer for about 15 minutes. The resulting slurry is stable toward separation after sitting for several weeks and has a stable viscosity of 600-700 centipoise.

Example 3

A 4.1 g quantity of calcium stearate is added to about 250 g of 1-hexanol and heated at 132° F. (~56° C.) for 1 hour while agitating with a dispersion-type mixer. The result is a thick, milky white suspension. This admixture is combined with 117.0 g dipropylene glycol methyl ether and 143.0 g of the same polymer DRA material as in previous examples, and then mixed with a dispersion-type mixer for about 15 minutes. The resulting slurry is stable toward separation after sitting for several weeks and has a stable viscosity of approximately 800 centipoise.

Example 4 (Comparative)

The procedures of Examples 1-3 are followed but the dispersion of the fatty acid wax (either calcium stearate or ethylene bis-stearate) and liquid carrier (1-hexanol) is not heated. It is found that the final polymer DRA slurries show significant separation after several minutes.

Example 5 (Comparative)

A 4.5 g quantity of magnesium stearate is added to 208.7 g of 1-hexanol under ambient conditions (no heating). This admixture is then combined with 271.3 g of dipropylene glycol methyl ether and 212.0 g of the same precipitated polymer DRA materials as in previous examples. It is then mixed with a dispersion-type mixer for about 15 minutes. The resulting slurry is found to show significant separation after sitting several hours.

Example 6 (Comparative)

A 154.8 g quantity of 1-hexanol is combined with about 190.7 g of dipropylene glycol methyl ether and 149.8 g of the same precipitated polymer DRA material as in previous examples. The admixture is then mixed, at ambient temperature, using a dispersion-type mixer for about 15 minutes. The resulting slurry shows significant separation after sitting several minutes.

We claim:

1. A method for producing a stabilized polymer drag reducing agent slurry comprising combining a fatty acid wax and a liquid carrier to form a dispersion; pre-treating the dispersion by heating to partially dissolve the fatty acid wax in the liquid carrier; and combining therewith a particulate polymer drag reducing agent to form a stabilized polymer drag reducing agent slurry.

2. The method of claim 1 wherein the fatty acid wax is selected from the group consisting of stearic acid; Groups 1, 2, 12, and 13 metal salts of stearic acid; stearic acid amides; and stearic acid esters.

3. The method of claim 2 wherein the fatty acid wax is selected from the group consisting of magnesium stearate, calcium stearate, zinc stearate, aluminum stearate, sodium stearate, potassium stearate, ethylene bis-stearamide, stearamide, ethylene glycol monostearate, ethylene glycol distearate, propylene glycol monostearate, propylene glycol distearate, glycerol stearate, glycerol distearate, glycerol tristearate, diethylene glycol distearate, stearic anhydride, and combinations thereof.

4. The method of claim 1 wherein the liquid carrier is selected from the group consisting of aqueous and non-aqueous liquids.

5. The method of claim 4 wherein the liquid carrier is selected from water; alcohols and fatty alcohols, glycols and diols; glycol ethers; glycol esters; and mixtures thereof.

6. The method of claim 1 wherein the proportion of fatty acid wax to liquid carrier is from about 0.005:1 to about 0.200:1 by weight prior to pre-treatment.

7. The method of claim 6 wherein from about 0.5 percent to about 99 percent by weight of the fatty acid wax is dissolved in the liquid carrier during the pre-treatment.

8. The method of claim 7 wherein from about 1 to about 10 percent by weight of the fatty acid wax is dissolved in the liquid carrier during the pre-treatment.

9. The method of claim 1 wherein at least one additional component selected from the group consisting of partitioning agents, wetting agents, and rheology modifiers is included in the stabilized polymer drag reducing agent slurry.

10. The method of claim 1 wherein the fatty acid wax ranges from about 0.1 to about 30 percent by weight, based on the weight of the slurry.

11. The method of claim 1 wherein the polymer drag reducing agent is stabilized against settling, separation, agglomeration, or a combination thereof.

12. A stabilized polymer drag reducing agent slurry prepared by a method comprising combining a fatty acid wax and a liquid carrier to form a dispersion; pre-treating the dispersion by heating to partially dissolve the fatty acid wax in the liquid carrier where at least about 0.5 percent by weight of the fatty acid is dissolved; and combining therewith a particulate polymer drag reducing agent to form a stabilized polymer drag reducing agent slurry.

13. The slurry of claim 12 wherein the fatty acid wax is selected from the group consisting of stearic acid; Groups 1, 2, 12, and 13 metal salts of stearic acid; stearic acid amides; and stearic acid esters.

14. The slurry of claim 13 wherein the fatty acid wax is selected from the group consisting of magnesium stearate, calcium stearate, zinc stearate, aluminum stearate, sodium stearate, potassium stearate, ethylene bis-stearamide, stearamide, ethylene glycol monostearate, ethylene glycol distearate, propylene glycol monostearate, propylene glycol distearate, glycerol stearate, glycerol distearate, glycerol tristearate, diethylene glycol distearate, stearic anhydride, and mixtures thereof.

15. The slurry of claim 12 wherein the liquid carrier is selected from the group consisting of aqueous and non-aqueous liquids.

16. The slurry of claim 15 wherein the liquid carrier is selected from water; alcohols and fatty alcohols, glycols and diols; glycol ethers; glycol esters; and mixtures thereof.

17. The slurry of claim 12 wherein the proportion of fatty acid wax to liquid carrier is from about 0.005:1 to about 0.200:1 by weight prior to pre-treatment.

18. The slurry of claim 12 wherein from about 0.5 percent to about 99 percent by weight of the fatty acid wax is dissolved in the liquid carrier during the pre-treatment.

19. The slurry of claim 18 wherein from about 1 to about 10 percent by weight of the fatty acid wax is dissolved in the liquid carrier during the pre-treatment.

20. The slurry of claim 12 wherein at least one additional component selected from the group consisting of partitioning agents, wetting agents, and rheology modifiers is included in the stabilized polymer drag reducing agent slurry.

21. The slurry of claim 12 wherein the fatty acid wax ranges from about 0.1 to about 30 percent by weight, based on the weight of the slurry.

22. The slurry of claim 12 wherein the polymer drag reducing agent is stabilized against settling, separation, agglomeration, or a combination thereof.

23. A method of reducing drag in a hydrocarbon stream comprising incorporating a stabilized polymer drag reducing agent slurry in a hydrocarbon stream, the stabilized polymer drag reducing agent slurry having been prepared by a method comprising combining a fatty acid wax and a liquid carrier to form a dispersion; pre-treating the dispersion by heating to partially dissolve the fatty acid wax in the liquid carrier where at least about 0.5 percent by weight of the fatty acid is dissolved; and combining therewith a particulate polymer drag reducing agent to form the stabilized polymer drag reducing agent slurry where the stabilized polymer drag reducing agent slurry has increased viscosity as compared to a slurry where no fatty acid wax is dissolved.

24. A method for producing a stabilized polymer drag reducing agent slurry comprising combining a fatty acid wax selected from the group consisting of stearic acid; Groups 1, 2, 12, and 13 metal salts of stearic acid; stearic acid amides; and stearic acid esters; and a liquid carrier selected from water; alcohols and fatty alcohols, glycols and diols; glycol ethers; glycol esters; and mixtures thereof; to form a dispersion; pre-treating the dispersion by heating to partially dissolve the fatty acid wax in the liquid carrier; and combining therewith a particulate polymer drag reducing agent to form a stabilized polymer drag reducing agent slurry.

25. The method of claim 24 wherein the fatty acid wax is selected from the group consisting of magnesium stearate, calcium stearate, zinc stearate, aluminum stearate, sodium stearate, potassium stearate, ethylene bis-stearamide, stearamide, ethylene glycol monostearate, ethylene glycol distearate, propylene glycol monostearate, propylene glycol distearate, glycerol stearate, glycerol distearate, glycerol tristearate, diethylene glycol distearate, stearic anhydride, and combinations thereof.

26. The method of claim 24 wherein the proportion of fatty acid wax to liquid carrier is from about 0.005:1 to about 0.200:1 by weight prior to pre-treatment; and wherein from about 0.5 percent to about 99 percent by weight of the fatty acid wax is dissolved in the liquid carrier during the pre-treatment; and wherein the fatty acid wax ranges from about 0.1 to about 30 percent by weight, based on the weight of the slurry; and wherein the polymer drag reducing agent is stabilized against settling, separation, agglomeration, or a combination thereof.

27. A stabilized polymer drag reducing agent slurry prepared by a method comprising combining a fatty acid wax selected from the group consisting of stearic acid; Groups 1, 2, 12, and 13 metal salts of stearic acid; stearic acid amides; and stearic acid esters; and a liquid carrier selected from water; alcohols and fatty alcohols, glycols and diols; glycol ethers; glycol esters; and mixtures thereof; to form a dispersion; pre-treating the dispersion by heating to partially dissolve the fatty acid wax in the liquid carrier where at least about 0.5 percent by weight of the fatty acid is dissolved; and combining therewith a particulate polymer drag reducing agent to form a stabilized polymer drag reducing agent slurry, wherein the fatty acid wax is selected from the group consisting of zinc stearate, aluminum stearate, sodium stearate, potassium stearate, ethylene bis-stearamide, stearamide, ethylene glycol monostearate, ethylene glycol distearate, propylene glycol monostearate, propylene glycol distearate, glycerol stearate, glycerol distearate, glycerol tristearate, diethylene glycol distearate, stearic anhydride, and combinations thereof.

28. The slurry of claim 27 wherein the proportion of fatty acid wax to liquid carrier is from about 0.005 to about 0.200:1 by weight prior to pre-treatment; and wherein from about 0.5 percent to about 99 percent by weight of the fatty acid wax is dissolved in the liquid carrier during the pre-treatment; and wherein the fatty acid wax ranges from about 0.1 to about 30 percent by weight, based on the weight of the slurry; and wherein the polymer drag reducing agent is stabilized against settling, separation, agglomeration, or a combination thereof.

29. A method of reducing drag in a hydrocarbon stream comprising incorporating a stabilized polymer drag reducing agent slurry in a hydrocarbon stream, the stabilized polymer drag reducing agent slurry having been prepared by a method comprising combining a fatty acid wax selected from the group consisting of stearic acid; Groups 1, 2, 12, and 13 metal salts of stearic acid; stearic acid amides; and stearic acid esters; and a liquid carrier selected from water; alcohols and fatty alcohols, glycols and diols; glycol ethers; glycol esters; and mixtures thereof; to form a dispersion; pre-treating the dispersion by heating to partially dissolve the fatty acid wax in the liquid carrier where at least about 0.5 percent by weight of the fatty acid is dissolved; and combining therewith a particulate polymer drag reducing agent to form a stabilized polymer drag reducing agent slurry where the stabilized polymer drag reducing agent slurry has increased viscosity as compared to a slurry where no fatty acid wax is dissolved.

* * * * *